US008951169B1

(12) United States Patent
Casper

(10) Patent No.: US 8,951,169 B1
(45) Date of Patent: Feb. 10, 2015

(54) THERAPEUTIC EXERCISE DEVICE

(76) Inventor: Dwight E. Casper, Irving, TX (US)

( * ) Notice: Subject to any disclaimer, the term of this patent is extended or adjusted under 35 U.S.C. 154(b) by 154 days.

(21) Appl. No.: 13/371,793

(22) Filed: Feb. 13, 2012

Related U.S. Application Data

(60) Provisional application No. 61/442,424, filed on Feb. 14, 2011.

(51) Int. Cl.
*A63B 23/14* (2006.01)
*A63B 21/072* (2006.01)
*A63B 21/075* (2006.01)

(52) U.S. Cl.
USPC ..... 482/106; 482/44; 482/45; 482/107

(58) Field of Classification Search
USPC ..... 482/44–46, 49, 50, 73, 81, 82, 92–94, 482/105–109
See application file for complete search history.

(56) References Cited

U.S. PATENT DOCUMENTS

| | | | | | |
|---|---|---|---|---|---|
| 3,184,234 | A * | 5/1965 | Struble | 482/46 |
| 3,942,790 | A * | 3/1976 | Rice | 482/91 |
| 4,838,542 | A * | 6/1989 | Wilkinson | 482/45 |
| 5,242,349 | A * | 9/1993 | Reiff et al. | 482/106 |
| 5,300,002 | A * | 4/1994 | Freye | 482/114 |
| 5,364,325 | A * | 11/1994 | Matthews | 482/111 |
| 5,653,664 | A * | 8/1997 | Jennings | 482/93 |
| 5,820,531 | A * | 10/1998 | Choi | 482/93 |
| 5,941,799 | A * | 8/1999 | Bergdorf | 482/44 |
| 6,599,222 | B2 * | 7/2003 | Wince | 482/106 |
| 2012/0302409 | A1 * | 11/2012 | Mikulski | 482/93 |

* cited by examiner

*Primary Examiner* — Stephen Crow
*Assistant Examiner* — Nyca T Nguyen
(74) *Attorney, Agent, or Firm* — Kenneth L. Tolar

(57) ABSTRACT

A therapeutic exercise device includes an elongated, hollow tube having a sleeve slidably and rotatably mounted thereon. The sleeve is held on the tube by a pair of opposing retainers, each having a rounded end cap attached thereto. Either cap is removable to expose an interior chamber for receiving a desired number of weighted cylinders that vary the overall weight of the tube. Accordingly, a user loads the chamber with a desired number of weighted cylinders and grasps the tube with one hand. The sleeve is grasped and reciprocally rotated with the other hand to exert the hand, wrist and forearm muscles.

1 Claim, 1 Drawing Sheet

THERAPEUTIC EXERCISE DEVICE

CROSS REFERENCE TO RELATED APPLICATIONS

This application is entitled to the benefit of provisional application No. 61/442,424 filed on Feb. 14, 2011.

BACKGROUND OF THE INVENTION

The present invention relates to an exercise device for strengthening the wrists, forearms and/or hands that is particularly designed for those undergoing physical therapy or who are otherwise unable to perform strenuous exercises.

DESCRIPTION OF THE PRIOR ART

The wrists and hands are far more injury prone than other parts of the body since they are subjected to extreme trauma when breaking a fall, punching or striking objects with hand-held implements. Furthermore, certain physical professions can cause debilitating hand and wrist injuries, such as carpal tunnel syndrome.

Physical therapy for such injuries typically focuses on strengthening the hand, wrist and forearm. However, conventional strengthening tools, such as dumbbells or weight machines, generally focus on the upper arms, chest, shoulders or biceps; very few exercises have been created to target the wrists, hands and forearms using a conventional weighted implement.

Accordingly, there is currently a need for an exercise tool that is specifically designed to rehabilitate hand, wrist and forearm injuries. The present invention addresses this need by providing a weighted tube having a rotatable sleeve slidably mounted thereon that is rolled by either hand to strengthen the wrists, hands and forearms. The sleeve is slidable to any desired position along the tube to allow a user to perform exercises in variable hand orientations for a more comprehensive rehabilitation regimen. The device is designed to mildly exert the target muscles, as compared to conventional exercise weights, when engaging in physical therapy, rehabilitation or other strengthening programs.

SUMMARY OF THE INVENTION

The present invention relates to a therapeutic exercise device comprising an elongated, hollow tube having a sleeve slidably and rotatably mounted thereon. The sleeve is held on the tube by a pair of opposing retainers, each having a rounded end cap attached thereto. Either cap is removable to expose an interior chamber for receiving any desired number of weighted cylinders that vary the overall weight of the tube. Accordingly, a user loads the chamber with a desired number of weighted cylinders and grasps the tube with one hand. The sleeve is grasped and reciprocally rotated with the other hand to exert the hand, wrist and forearm muscles.

It is therefore an object of the present invention to provide an exercise device that specifically targets the wrist, hand and forearm muscles.

It is another object of the present invention to provide an exercise device that allows a patient to conveniently and effectively rehabilitate certain injuries.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
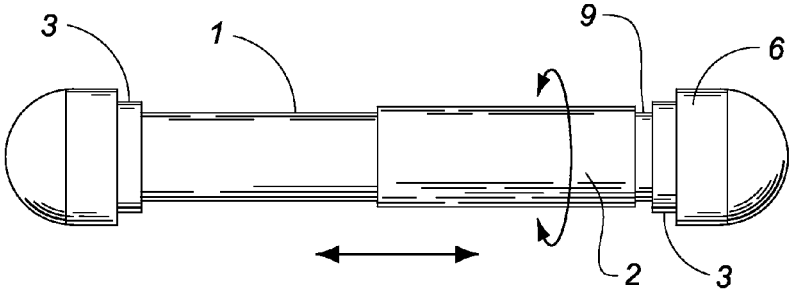
FIG. 1 is a plan view of the exercise device according to the present invention.
Figure 2:
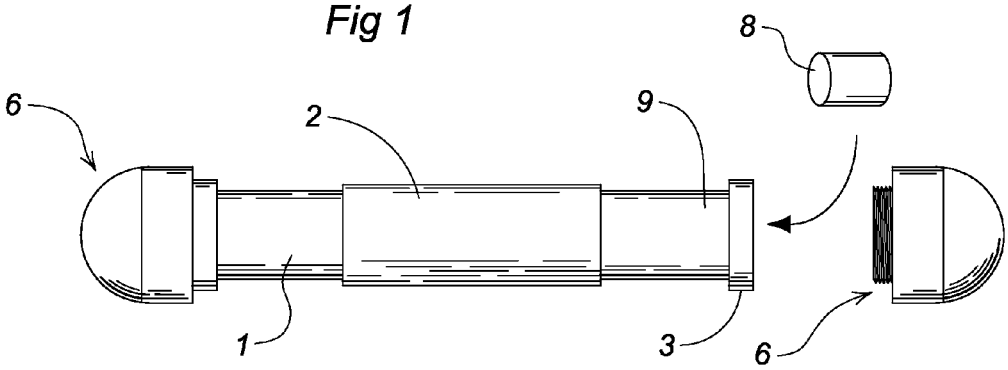
FIG. 2 depicts the device of FIG. 1 with one of the end caps removed.
Figure 3:
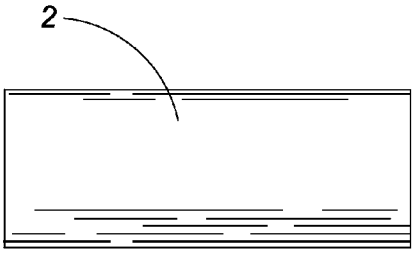
FIG. 3 is an isolated view of the sleeve.
Figure 4:
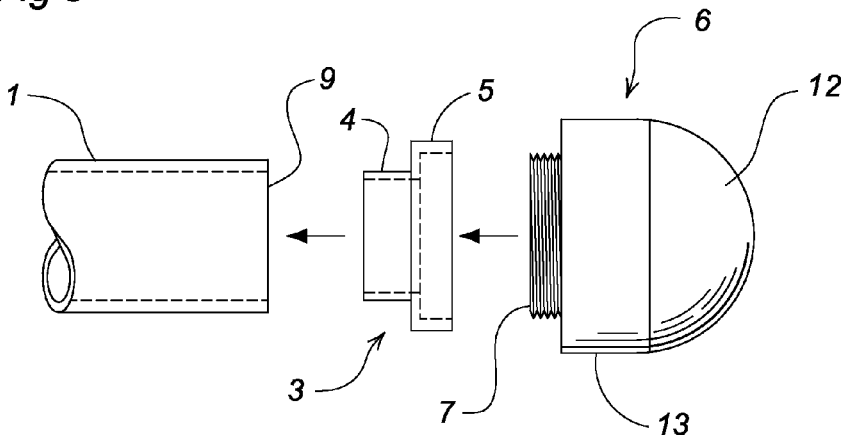
FIG. 4 is an isolated, sectional view of an end of the tube.

The present invention relates to a therapeutic exercise device comprising an elongated, hollow tube 1 having a pair of opposing, open ends 9, each in communication with an interior chamber. Slidably mounted on the tube is a rotatable sleeve 2 that is reciprocally rolled with either hand to perform various exercises that target wrist, hand and forearm muscles. The tube and sleeve are constructed with a polypropylene plastic or a similar lubricous material that allows the sleeve to smoothly rotate or slide upon application of a predetermined amount of force. However, the sleeve and tube have a minimal amount of friction therebetween so that the sleeve retains a selected longitudinal position along the tube when relocated by the user.

Attached to each of the two opposing, open ends 9 is a retainer 3 that prevents the sleeve and tube from separating. Each retainer includes an insert 4 that is received within the open end 9, and an internally-threaded collar 5 on an outwardly-facing surface that has a diameter greater than that of both the sleeve and the tube.

Removably fastened to each retainer is an end cap 6 having a hemispherical outer portion 12 and a cylindrical inner portion 13 with an externally-threaded post 7 extending therefrom. The post 7 threadedly seats within the collar to removably secure the end cap to the tube. Either cap may be removed to load a desired number of weighted cylinders 8 into the interior chamber to vary the overall weight of the tube.

The configuration of each end cap forms a blunt surface that will not damage nearby objects or injure an exerciser; furthermore, the rounded end caps create a unique and aesthetical exercise tool as compared to mundane dumbbells and other conventional exercise equipment.

Accordingly, a user slides the sleeve to a desired position on the tube and loads the chamber with a suitable number of weighted cylinders; the user grasps the tube with one hand and the sleeve with the other hand; either or both wrists are repeatedly rolled in a desired direction to exert the hand, wrist and forearm muscles.

Any one of a virtually-unlimited number of exercises may be performed to target certain muscle groups or to vary the intensity of a particular exercise regimen. For example, a user could hold his or her arms horizontally, in front of the torso, or vertically, near the user's waist. Furthermore, the tube could be placed in various other positions or the arms could be rested on a support surface during the performance of certain exercises. Finally, the slidable sleeve allows the relative positioning of the hands to be varied to create a more comprehensive and effective exercise routine.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A therapeutic exercise device comprising:

an elongated, hollow tube having a pair of opposing, open ends in communication with an interior chamber;

a number of desired weighted cylinders received within said interior chamber, each of said cylinders insertable into or removable from either of said opposing open ends to vary an overall weight of said tube;

a rotatable sleeve on said tube that is reciprocally rolled with either hand to perform various exercises that target wrist, hand and forearm muscles, said sleeve slidable on said tube to allow a user to longitudinally reposition said sleeve relative to said tube to vary a relative orientation of an exerciser's hands during an exercise regimen;

a retainer attached to each of said two opposing ends that prevents said sleeve and said tube from separating, wherein said retainer includes a collar having a diameter greater than a diameter of both the sleeve and the tube;

an end cap removably fastened to said collar, said end cap having a hemispherical outer portion and a cylindrical inner portion for blunting the end of said tube;

a threaded post extending from the cylindrical inner portion of said end cap that threadedly engages said collar to removably secure said end cap to said tube.

* * * * *